US012442362B2

(12) United States Patent
Albrecht et al.

(10) Patent No.: US 12,442,362 B2
(45) Date of Patent: Oct. 14, 2025

(54) DOSAGE PUMP WITH LOW ENERGY CONSUMPTION

(71) Applicant: Ecolab USA Inc., Saint Paul, MN (US)

(72) Inventors: Rudolf Albrecht, Bad Aibling (DE); Max Lackner, Inzell (DE)

(73) Assignee: Ecolab USA Inc., Saint Paul, MN (US)

( * ) Notice: Subject to any disclaimer, the term of this patent is extended or adjusted under 35 U.S.C. 154(b) by 3 days.

(21) Appl. No.: 18/575,907

(22) PCT Filed: Jul. 2, 2021

(86) PCT No.: PCT/EP2021/068304
§ 371 (c)(1),
(2) Date: Jan. 2, 2024

(87) PCT Pub. No.: WO2023/274553
PCT Pub. Date: Jan. 5, 2023

(65) Prior Publication Data

US 2024/0369049 A1 Nov. 7, 2024

(51) Int. Cl.
*F04B 7/00* (2006.01)
*F04B 43/02* (2006.01)

(52) U.S. Cl.
CPC ..... *F04B 7/0069* (2013.01); *F04B 43/02* (2013.01)

(58) Field of Classification Search
CPC ..... F04B 7/0057; F04B 7/0069; F04B 43/02
See application file for complete search history.

(56) References Cited

U.S. PATENT DOCUMENTS 2,308,974 A * 1/1943 Harper ..... F04B 7/0053 600/16
2,785,638 A * 3/1957 Moller ..... F04B 43/02 251/129.09

(Continued)

FOREIGN PATENT DOCUMENTS

BE 859723 A * 4/1978 ..... A61M 5/16809
DE 2619988 A1 11/1976

(Continued)

OTHER PUBLICATIONS

International Search Report and Written Opinion for PCT/EP2021/068304 mailed Feb. 11, 2022, 9 pages.

*Primary Examiner* — Nathan C Zollinger
(74) *Attorney, Agent, or Firm* — Fredrikson & Byron, P.A.

(57) ABSTRACT

It is provided a dosage pump (10) comprising a pump housing (12), a first valve (18), a second valve (20), an actuation lever (22), wherein the actuating lever (22) is adapted to be tilted around a tilting axis (24), a disc (34) for providing a torque, wherein the disc (34) is adapted to rotate around an input axis, a first cam (26) connected to the disc (34) and a second cam (30) connected to the disc (34), wherein the actuating lever (22) comprises a first raceway (28), wherein the first raceway (28) and the second raceway (32) are formed such that at least partially during an angle of rotation of the disc (34), where the actuation lever (22) has to apply an actuation force for opening and/or closing the first valve (18) and/or the second valve (20), the first cam (26) or the second cam (30), whose contact point to its corresponding raceway (28, 32) is farer away from the tilting axis (24) of the actuation lever (22) and/or adjusted to a lower torque at the actual angle of rotation of the disc (34), provides the tilting force onto the actuation lever (22). Due to the at least two cams (26, 30) the actuation force at the (Continued)

valves (18, 20) can be provided by means of the cam (26, 30) with a large lever arm, so that a lower torque of the disc (34) is sufficient, which can be generated with a lower energy consumption.

15 Claims, 6 Drawing Sheets

(56) References Cited

U.S. PATENT DOCUMENTS 4,236,881 A * 12/1980 Pfleger ..... F04B 43/02
417/510
4,303,376 A * 12/1981 Siekmann ..... F04B 7/0053
417/384

FOREIGN PATENT DOCUMENTS

FR 860977 A 1/1941
WO WO-2013156087 A1 * 10/2013 ..... F04B 15/04

* cited by examiner

DOSAGE PUMP WITH LOW ENERGY CONSUMPTION

This application is a 35 U.S.C. 371 national phase filing from International Application No. PCT/EP2021/068304, filed Jul. 2, 2021. The entire contents of this application are incorporated herein by reference.

TECHNICAL FIELD OF THE INVENTION

The invention relates to a dosage pump, by means of which a fluid can be fed, particularly a rinse aid or a detergent aid and washing water.

BACKGROUND OF THE INVENTION

WO 2013/156087 A1 discloses a diaphragm pump used as dosage pump, wherein two valves of the diaphragm pump are actuated by means of an actuation lever, which can be tilted by means of a cam sliding inside an oval ring of the actuation lever.

There is a permanent need reducing the energy consumption of a dosing pump.

It is the object of the invention enabling a low energy consumption of a dosing pump.

SUMMARY OF THE INVENTION

The solution of this object is provided according to the invention by a dosage pump according to the features of claim 1. Preferred embodiments of the invention are given by the dependent claims, which can constitute each solely or in combination an aspect of the invention.

An aspect of the invention is directed to a dosage pump, in particular for use as a detergent dosage pump for ware washing applications, comprising a pump housing, a first valve for feeding a fluid, wherein particularly the first valve is connected with the pump housing, a second valve for discharging the fluid, wherein particularly the first valve is connected with the pump housing, an actuation lever for actuating the first valve as well as the second valve, wherein the actuating lever is adapted to be tilted around a tilting axis with respect to the pump housing, a rotatable disc for providing a torque generated in a motor connectable to the disc, wherein the disc is adapted to rotate around an input axis of rotation, a first cam connected to the disc and a second cam connected to the disc, wherein the actuating lever comprises a first raceway for bearing a first tilting force for tilting the actuation lever provided by the first cam at a first contact point and a second raceway for bearing a second tilting force for tilting the actuation lever provided by the second cam at a second contact point, wherein the first raceway and the second raceway are formed such that at least partially during an angle of rotation of the disc, where the actuation lever has to apply an actuation force for opening and/or closing the first valve and/or the second valve, the first cam or the second cam, whose contact point to its corresponding raceway is farer away from the tilting axis of the actuation lever at the actual angle of rotation of the disc and/or whose contact point to its corresponding raceway is adjusted to a lower torque at the actual angle of rotation of the disc, provides the tilting force onto the actuation lever.

The alignment of the actuation lever, particularly its swivel angle, is defined by the angle of rotation of the disc. The swivel angle of the actuation lever defines which valve of the first valve and/or the second valve is actuated, particularly opened. Since the actuation lever has to be tilted only within a limited swivel angle for actuating the first valve and the second valve, the actuation laver can be tilted by means of a cam applying the tilting force at a raceway of the actuation lever, wherein the cam is driven by the disc. More details for tilting the actuation lever are described in WO 2013/156087 A1, whose content is herewith incorporated by reference as part of the invention. The respective valve requires a specific minimum force for being actuated, which is applied by the actuation force of the tilted actuation lever, which may cooperate with a valve stem of the corresponding valve. The actuation force of the actuation lever is provided by the torque introduced by the disc and generated in a motor connected to the disc. The torque of the disc, which is provided by a motor, leads to the tilting force, whose amount depends on the lever arm between the input axis and the contact point of the cam with the raceway of the actuation lever. Since this lever arm remains mainly constant during the angle of rotation of the disc, the tilting force applied to the actuation lever by the cam remains also mainly constant. However, the tilting axis of the actuation lever may be positioned significantly spaced to the input axis of the disc reducing the needed tilting force at the contact point between the respective cam and the respective raceway of the actuation lever. When the cam moves along the raceway of the actuation lever, the lever arm between the contact point of the cam with the raceway and the tilting axis changes, so that the torque of the actuation lever at the tilting axis changes. Since the actuation force of the actuation lever is dependent from the torque of the actuation lever and the lever arm between the tilting axis and the contact point with the corresponding valve, also the amount of the actuation force provided by the actuation lever changes. Generally, the torque introduced by the disc has to be dimensioned to the worst case, where the lever arm between the contact point of the cam with the raceway and the tilting axis is at its minimum, when the distance between the input axis and the contact point of the cam is at its maximum at the same time, for providing a sufficient actuation force and for preventing a blocking of the actuation lever, which would lead to a motor connected to the disc which is over-dimensioned for most of the time with respect to its electric power and its energy consumption.

Since the actuation lever is tilted not only by one cam, but by at least two or more cams, it is possible that in a situation, when the lever arm between the contact point of the one cam with its corresponding raceway and the tilting axis becomes too short, the other cam can take over the function of applying the tilting force to the actuation lever, when the lever arm between the contact point of the other cam with its corresponding raceway and the tilting axis is larger. The respective cam provides a contact surface positioned eccentric with respect to the input axis of the disc, which may contact its respective race way along a particular range of the rotation angle of the disc and may be lift of from its respective race way along a particular different range of the rotation angle of the disc. This kinematic can be easily provided by the forming of the corresponding raceways of the actuation lever. The first raceway and the second raceway and, if so, further raceways, can be formed such, that the cam with the shorter lever arm to the tilting axis lifts from its corresponding raceway, while the other cam with the larger lever arm to the tilting axis contacts its corresponding raceway, so that the tilting force is applied via the larger lever arm. When the cam with the larger lever arm is in contact with its raceway, the actuation lever cannot tilt back for contacting the cam with the shorter lever arm, so that the intended movement of the actuation lever is not significantly disturbed. When the lever arm of the other cam becomes too short a further cam or the prior cam can take over the function of applying the tilting force to the actuation lever. When the first cam or the first contact point to the first raceway is positioned farer away from the tilting axis than the second cam, the first cam can apply the tilting force with a larger lever arm than the second cam, so that it is the first cam which provides the tilting force to the actuation lever due to the suitable forming of the first raceway and the second raceway. When the second cam or the second contact point to the second raceway is positioned farer away from the tilting axis than the first cam, the second cam can apply the tilting force with a larger lever arm than the first cam, so that it is the second cam which provides the tilting force to the actuation lever due to the suitable forming of the first raceway and the second raceway. As long as the lever arm of the cam with the shorter lever arm is large enough for providing a sufficient actuation force, the cam with the shorter lever arm may still provide the tilting force onto the actuation lever, so that a high freedom in forming the raceways is given. However, there is at least a range of the angle of rotation of the disc, where only the farer away cam with the large lever arms only provides the required tilting force onto the actuation lever. Preferably the range of the angle of rotation of the disc, where only the farer away cam with the large lever arms only provides the tilting force, is maximized by means of the forming of the raceways. If so, the range of the angle of rotation of the disc, where only the farer away cam with the large lever arms only provides the tilting force, is chosen such that only in the range of the angle of rotation of the disc, where at least one valve shall be actuated, the tilting force onto the actuation lever is provided by the cam, which is positioned furthermost with respect to the tilting axis. Due to the at least two cams the actuation force at the valves can be provided by means of the cam with a large lever arm, so that a lower torque of the disc is sufficient, which can be generated with a lower energy consumption.

The first contact point between the first cam and the first raceway as well as the second contact point between the second cam and the second raceway are understood as a point where the resulting force of the first or second tilting force is introduced into the actuation lever. The surface of the first cam contacting the first raceway and/or the surface of the second cam contacting the second raceway could be mainly point-shaped or larger than point-shape, particularly for preventing a high stress of the material of the respective cam at the contact point.

The first valve and the second valve can be fixed to the pump housing. The first valve and the second valve can be positioned spaced to each other, so that at two different ranges of the swivel angle of the actuating lever the first valve or the second valve can be actuated. Thereby, the first valve only, the second valve only or neither the first valve nor the second valve can be opened depending on the angle of rotation of the disc. For instance, the fluid can be sucked into a fluid chamber of a pump, particularly a membrane pump, via the first valve and discharged from the fluid chamber via the second valve. The actuation lever can be tilted between a position, where the first valve is opened for feeding the fluid, and a position, where the second valve is opened for discharging the fluid, wherein the actuation lever may remain in the respective position for a defined period of time.

The first valve and the second valve can be designed as check valve, wherein the respective check valve may comprise a valve stem, by which an opening of the valve van closed or opened. The actuation lever may cooperate with the valve stem of the respective valve, wherein the actuation force may push or pull the valve stem for actuating the valve. Particularly the first valve and/or the second valve are normally closed, wherein the actuation force is applied to open the respective valve.

The actuation lever may be beard by a shell cooperating with a bold. Particularly the shell is one-piece with the actuation lever and/or the bold is one-piece with the pump housing or vice versa. The pump housing may be designed for being connected to another part, for instance with a housing of a washing machine, dish washer or the like. The pump housing may be ridged and/or stiff enough for supporting the weight of the dosing pump and/or occurring forced, when the dosing pump is operated. The pump housing may house the disc, the cams and the actuation lever. Particularly the housing may also house an electric operated motor, wherein connection lines for feeding electrical energy to the motor and/or other lines may be fed through the pump housing. Particularly the pump housing comprises a frame-like housing wall, which can be closed by means of a cover lid. The pump housing and/or the actuation lever may be made from a plastic material, particularly a thermoplastic material. If so, the raceways and/or the cams may comprise a wear resistant surface, for instance provided by a friction reducing coating. The pump housing may comprise a fluid chamber for pumping the fluid. One side of the fluid chamber may be bordered by a membrane, which can be deformed for decreasing and increasing the volume of the fluid chamber. When the volume of the fluid chamber is increased the fluid can be sucked into the fluid chamber via the opened first valve. After closing the first valve, the volume of the fluid chamber can be reduced for pumping the sucked in fluid towards a corresponding outlet provided by the second valve. Particularly the membrane can be deformed in dependence of the angle of rotation of the disc, so that the opening and closing of the first valve and the second valve can be coordinated with the change of the volume of the fluid chamber.

Particularly the first raceway and the second raceway are formed such that at least partially during an angle of rotation of the disc, where the actuation lever has to apply no actuation force, the first cam and the second cam are positioned both in an area between the input axis and the tilting axis or the second cam are positioned both outside the area between the input axis and the tilting axis.

When the disc rotates around its input axis the cams, which are connected to the disc spaced to the input axis, both cams can be positioned in an area between the input axis and the tilting axis during a specific range of the angle of rotation of the disc as well as in an area or outside this area during another specific range of the angle of rotation of the disc. When both cams are positioned in the area between the input axis and the tilting axis, each lever arm of both cams is short so that only a low actuation force can be provided. However, when an actuation of neither the first valve nor the second valve shall take place during the angle of rotation of the disc, where both cams are arranged in the area between the input axis and the tilting axis, an actuation force is not even needed so that an actuation force of a particular minimum amount provided by the tilting force applied onto the tilting lever can be omitted. A spring force of the first valve and/or the second valve aligned in the opposite direction of the actuation force may press at least one raceway against the corresponding cam so that a rattling can be prevented, but the cam contacting its corresponding raceway do not need to counteract the present spring force, so that a short lever arm can be accepted during this range of the angle of rotation of the disc. The same situation may apply, when both cams are positioned far away from the tiling axis. When one cam is positioned in the area between the input axis and the tilting axis and the other cam is positioned outside this area, at least one valve can be actuated by the actuation lever during the respective angle of rotation, so that a situation is present, where the applied actuation force can be preferably by means of the cam with the larger lever arm, so that the cam with the larger lever arm can take over the duty of applying the actuation force to the actuation lever.

Preferably the first raceway and the second raceway are formed such, that mainly either the first cam or the second cam only provides the first tilting force or the second tilting force respectively at the actuation lever. Besides the specific angle of rotation of the disc, where the function of providing the tilting force onto the actuation lever changes between the first cam and the second cam, only one cam provides the tilting force and/or only one cam is in contact with its corresponding race way. A clamping of two cams between their corresponding raceways of the actuation lever can be prevented, so that a blocking of the movement of the actuation lever can be prevented.

Particularly preferred the first cam is rotatably connected to the disc and adapted to rotate around a first axis of rotation, wherein the first axis of rotation is aligned mainly in parallel and offset to the input axis of rotation, wherein the second cam is rotatably connected to the disc and adapted to rotate around a second axis of rotation, wherein the second axis of rotation is aligned mainly in parallel and offset to the input axis of rotation. Due to the rotatable cam the cam can roll along its respective raceway provided by the actuation lever. Unnecessary friction and wear can be reduced so that the life time of the dosage pump can be increased.

Particularly the first cam and/or the second cam is designed as a rotatable roller, particularly a bearing, adapted to roll along the respective first raceway or second raceway. The respective cam can be designed as a slide bearing or a rolling bearing, wherein the disc may provide a an adapter for providing a force or torque to the respective bearing-like cam. This enables the use of cheap standard part for the first cam and/or the second cam.

Particularly preferred the input axis of the disc and the tilting axis of the actuation lever are arranged on a middle line, wherein the first axis of rotation of the first cam and the second axis of rotation of the second cam are arranged on a cam line, wherein the first raceway and the second raceway are formed such, that the presence of the first tilting force provided by the first cam at the first raceway and the second tilting force provided by the second cam at the second raceway changes when the cam line is aligned mainly in parallel to the middle line during the rotation of the disc or inclined to a parallel alignment to the middle line (38) by an angle of maximum 60°, particularly maximum 30°, preferably maximum 15° and particularly preferred maximum 5°, during the rotation of the disc. The one cam contacting its raceway of the actuation lever can tilt the actuation lever in one circumferential direction during the rotation of the disc. When the cam line is arranged roughly, for instance ±60°, particularly ±30°, preferably ±150 and particularly preferred ±5°, in parallel to the middle line, the contacting cam would move away from the raceway so that the actuating lever would tilt in the opposite circumferential direction. Instead of this the other cam comes into contact with its raceway and the former contacting cam comes out of contact from its raceway when the cam line is arranged roughly in parallel to the middle line that forming of the corresponding raceway can enable a further tilting of the actuating lever in the former circumferential direction. Due to the presence of at least two cams the maximum swivel angle of the actuating lever can be increased, so that the same actuation stroke for the respective valve can be provided with a shorter actuating lever leading to a more compact and reduced packaging size of the dosing pump.

Particularly the first axis of rotation of the first cam and the second axis of rotation of the second cam are spaced in circumferential direction with respect to each other, particularly by mainly 90°±30°, preferably 90°±150 and particularly preferred 90°±5°. The amount of the tilting force provided by the first cam and the second cam can be mainly the same, when one of the cams take over the function for applying the tilting force from the other cam, since the distance of both cams to the tilting axis is mainly the same at this angle of rotation. The actuation force at the valves may be mainly the same and independent from which cam the corresponding tilting force is provided.

Particularly preferred the first axis of rotation of the first cam and the second axis of rotation of the second cam are positioned at mainly the same radial distance to the input axis of the disc. The required building space can be kept low. Further the first cam and the second cam can be provided by same parts, which may positioned at different heights for interacting with its respective raceway. Due to the offset in circumferential direction of the disc by mainly 90° the swivel angle of the actuation lever can be increased taking into account that there is a range of the angle of rotation of the disc, where no actuation force shall be applied to the valves so that during this range of the angle of rotation of the disc both cams may have a short lever arm at the same time.

Preferably the first raceway and the second raceway are positioned at different heights with respect to the axial direction of the input axis. The first cam and the second cam do not have to share the same raceway, so that each of the separate raceways can be formed independently of each other. This enables a forming of the first raceway and the second raceway which could intersect each other without disturbing each other. The freedom of providing a particular tilting movement of the actuation lever can be increased.

Particularly preferred the first cam and the second cam are positioned at different heights with respect to the axial direction of the input axis, wherein the first cam overlaps the second raceway at a part of the angle of rotation of the disc and/or the second cam overlaps the first raceway at another part of the angle of rotation of the disc when viewed in axial direction of the disc. The first raceway and the second raceway could intersect each other without disturbing each other. The disc could comprise a stepped forming and/or a changing thickness in axial direction in circumferential direction at different circumferential angles, so that the first cam could be positioned onto another level in axial direction of the input axis than the second cam. The freedom of providing a particular tilting movement of the actuation lever can be increased.

Particularly the actuation lever comprises a hollow frame, wherein the first raceway and the second raceway are formed at the inside of the frame. The cams can apply its tilting form from inside the tilting level instead of from outside the tilting lever. This enables a compact design for the dosage pump and a small packaging size. Further the disc and the cams do not need intermediate levers for tilting the actuation lever. Due to the hollow frame the actuation lever can be easily mounted with the dosage pump by putting the frame of the actuation lever on the prior mounted cams so that the actuation lever is loss proof connected with the cams in radial direction with respect to the input axis and loss proof in axial direction by means of a cover lid mounted to the pump housing at a later point of time.

Particularly preferred the input axis of the disc and the tilting axis of the actuation lever are arranged on a middle line, wherein the first valve and the second valve are positioned on different sides with respect to the middle line, wherein particularly the first valve and the second valve are spaced to the middle line by mainly the same distance. The distance between the valves may be defined in correspondence to the distance of the tilting axis to the respective contact point of the cam with its raceway and the torque provided by the disc.

When the actuation lever is tilted in a first circumferential direction, the corresponding valve can be actuated, wherein when the actuation lever is tilted in an opposite second circumferential direction, the other valve can be actuated. An actuation of both valves at the same time can be prevented. Due to the mainly symmetric arrangement of the first valve and the second valve with respect to the middle line the same swivel angle and the same actuation force can be provided to the first valve and the second valve. The first valve and the second valve can be designed identically or least similar, so that the number of same parts of the dosage pump can be increased and the manufacturing costs reduced.

Particularly the first valve and/or the second valve provides a reset force, particularly provided by a reset spring, wherein the reset force counteracts the actuation force of the actuating lever. Preferably the first valve and the second valve are "normally closed" by means of the reset force. The actuation force applied to the respective valve by the tilted actuation lever can overcome the reset force for actuating, particularly opening, the respective valve. When only a low actuation force is present, particularly due to a too short lever arm of the cam actually contacting its respective raceway, the reset force may tilt the actuation lever away from the corresponding valve so that this part of the tilting movement of the actuation lever can be provided by means of the reset force of the valve instead of one of the cams pushing the actuation lever in the intended circumferential direction around the tilting axis.

Preferably the disc is connected to a slidable pusher, wherein the pusher moves back and forth in dependence of the angle of rotation of the disc, wherein the pusher moves a reciprocating diaphragm bordering a fluid chamber for pumping the fluid, wherein the pusher is positioned offset in axial direction of the input axis with respect to the first cam and the second cam. The disc may comprise an, particularly eccentric, part, that is connected to the pusher for applying a reciprocal movement of the pusher in dependence of the angle of rotation of the disc. The rotation of the disc can be transformed into the linear movement of the pusher by means of joined levers and/or a further eccentric. Since the movement of the pusher and the movement of the actuation lever via the first and second cam depends on the angle of rotation of the disc, the actuation of the reciprocating diaphragm of the fluid chamber as well as the actuation of the first und second valve can be nearly perfectly synchronized. The operation of the dosage pump can be optimized.

Particularly preferred the pump housing bears the actuation force for opening and/or closing the first valve and/or the second valve as well as a bearing force of the actuation lever. The first valve and the second valve do not need to be mounted with and supported at a further part. The first valve and the second valve can be integrated into the dosage pump so that fluid channels for conducting the fluid can also be integrated into the dosage pump, particularly integrated into the pump housing. The number of fluid sealings can be kept low, so that the risks of leaking as well as the manufacturing costs can be reduced.

Particularly the disc is connected to a motor, wherein the maximum torque $M_{max}$ provided by the motor is chosen such with respect to the maximum torque $M(\varphi_{max})$ for tilting the actuation lever at a specific angle of rotation $\varphi_{max}$ of the disc that $75\% \leq M(\varphi_{max})/M_{max} \leq 100\%$, particularly $80\% \leq \delta \leq 89\%$ and preferably $85\% \leq \delta \leq 88\%$ applies. The motor can be a synchronous motor, particularly a stepper motor, which is particularly suitable for actuators and other applications in which a load-independent, stable speed is required. In addition, permanent magnet synchronous motors are more compact and efficient than asynchronous machines, especially for smaller machines. Since the maximum torque for tilting the actuation lever can be reduced by using the cam which is farer away from the tilting axis of the actuation lever, when an actuation force shall be applied to one of the valves, the motor connected to the disc can be designed smaller, when the motor is still operated close before its tipping point. Particularly the motor can be designed for a lower electric power so that the energy consumption can be reduced.

The technical teaching of the claimed invention can not only be realized in a physical device in the real world, but also in a computer generated virtual world, for instance as an virtual device constructed by a plurality of standard parts in a simulation tool, and/or in coded form as one or more data package(s), by means of which the technical teaching of the invention can be realized in the real word by means of a 3d-printer or other device adapted for processing the at least one data package for manufacturing the corresponding device defined in coded form by the at least one data package.

BRIEF DESCRIPTION OF THE FIGURES

These and other aspects of the invention will be apparent from and elucidated with reference to the embodiments described hereinafter, wherein the described features can constitute each solely or in combination an independent aspect of the invention. In the drawings.

DETAILED DESCRIPTION

Figure 1:
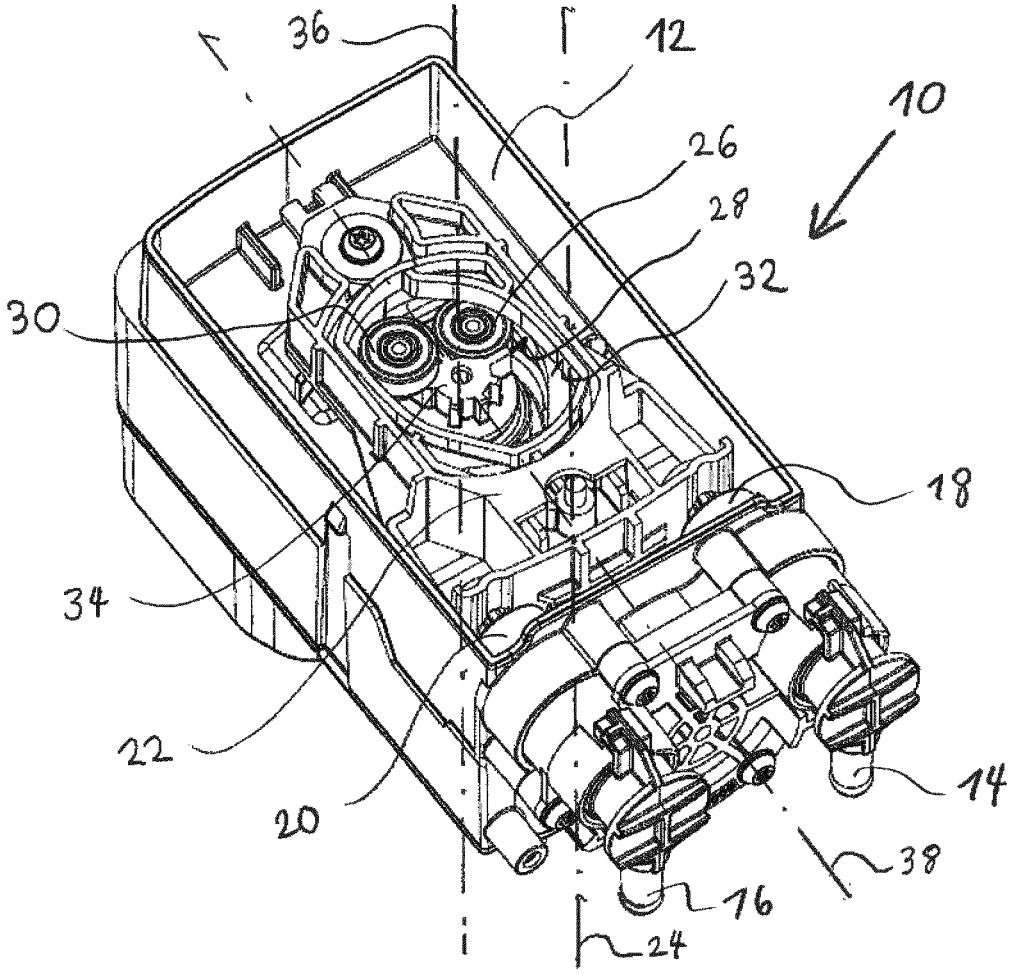
FIG. 1: is a schematic view of a part of a dosage pump.

The dosage pump 10 as illustrated in FIG. 1 could be used in a washing machine, dish washer or the like. The dosage pump 10 comprises a pump housing 12, which could be closed by means of not illustrated cover lid. An outlet 14 and an inlet 16 are mounted to the pump housing 12 for dispensing a fluid pumped by the dosage pump 10. The inlet 14 can be opened and closed by means of a first valve 18, wherein the outlet 16 can be opened and closed by means of a second valve 20. The first valve 18 and the second valve 20 can be designed as a spring-loaded normally closed check valve. The first valve 18 and the second valve 20 can be fixed to the pump housing 12 so that occurring forces of the first valve 18 and the second valve 20 can be supported by the pump housing 12.

The first valve 18 and the second valve 20 can be actuated by means of an actuation lever 22 which can be tilted around a tilting axis 24 over a limited swivel angle. When the actuation lever 22 tildes in a first circumferential direction, a valve stem of the first valve 18 can be moved or a valve stem of the second valve 20 can be moved against a spring force of a reset spring of the corresponding valve 18, 20 for opening the valve 18, 20. When the actuation lever 22 tildes in an opposite second circumferential direction, the other valve 20, 18 can be actuated against a spring force of a reset spring of the corresponding valve 20, 18 for opening the valve 20, 18. In the illustrated embodiment, the respective valve 18, 20 can be actuated by the actuation lever 22 by pulling the valve stem of the corresponding valve 18, 20.

The actuation lever 22 can be tilted by means of a first cam 26 applying a first tilting force at a first raceway 28 of the actuation lever 22 or by means of a second cam 30 applying a second tilting force at a second raceway 32 of the actuation lever 22. The first raceway 28 and the second raceway 32 are provided at the inside of the frame-like designed hollow actuation lever 22. The first cam 26 and the second cam 30 can be connected to a disc 34 which can be rotated around an input axis 36. The disc 34 can be driven by a synchronous motor for providing a torque. The first cam 26 and the second cam 30 can be rotatably connected to the disc 34 and may rotated around respective rotation axis which are located at mainly the same radius with respect to the input axis 36 and spaced to each other in circumferential direction with respect to the input axis 36 by mainly 90°. The first cam 26 and the second cam 30 can be designed like a roller or a bearing. The first cam 26 and the second cam 30 are positioned at different heights in axial direction of the input axis 36 so that the first cam 26 and the second cam 30 cannot disturb each other. Correspondingly the first raceway 28 and the second raceway 32 are positioned at different heights in axial direction of the input axis 36 so that the first raceway 28 and the second raceway 32 cannot disturb each other.

The input axis 36 of the disc 34 and the tilting axis 24 of the actuation lever 22 are positioned on a middle line 38. The first valve 18 and the second valve 20 are arrange at different sides of the middle line 38, particularly spaced to the middle line 38 by the same distance. The first valve 18 can be maximum opened at the maximum swivel angle of the actuation lever 22 in the first circumferential direction, wherein the second valve 20 can be maximum opened at the maximum swivel angle of the actuation lever 22 in the second circumferential direction, particularly by the same amount.

By means of the at least two cams 26, 30 and the specific forming of the first raceway 28 and the second raceway 32 the applied tilting force onto the actuation lever 22 can be provided by the cam 26, 30 with the larger lever arm with respect to the tilting axis 24 so that a low torque of the disc 34 provided by a small synchronous motor with a low energy consumption is sufficient for providing a high enough actuation force at the respective valve 18, 20 for overcoming the present reset force and opening the respective valve 18, 20.

Figure 2:
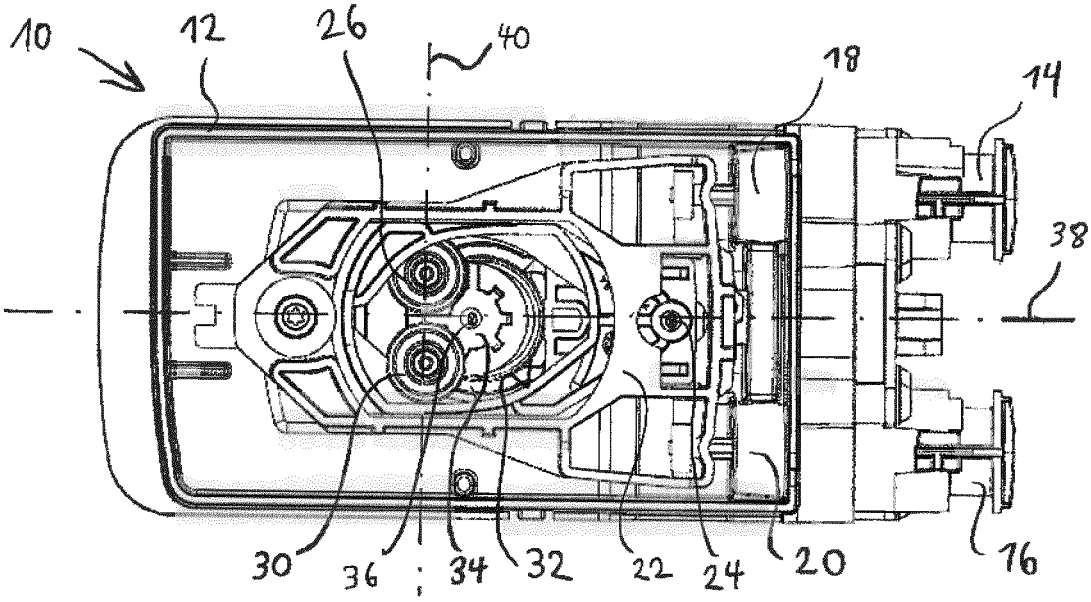
FIG. 2: is a schematic top view of the dosage pump of FIG. 1.
Figure 3:
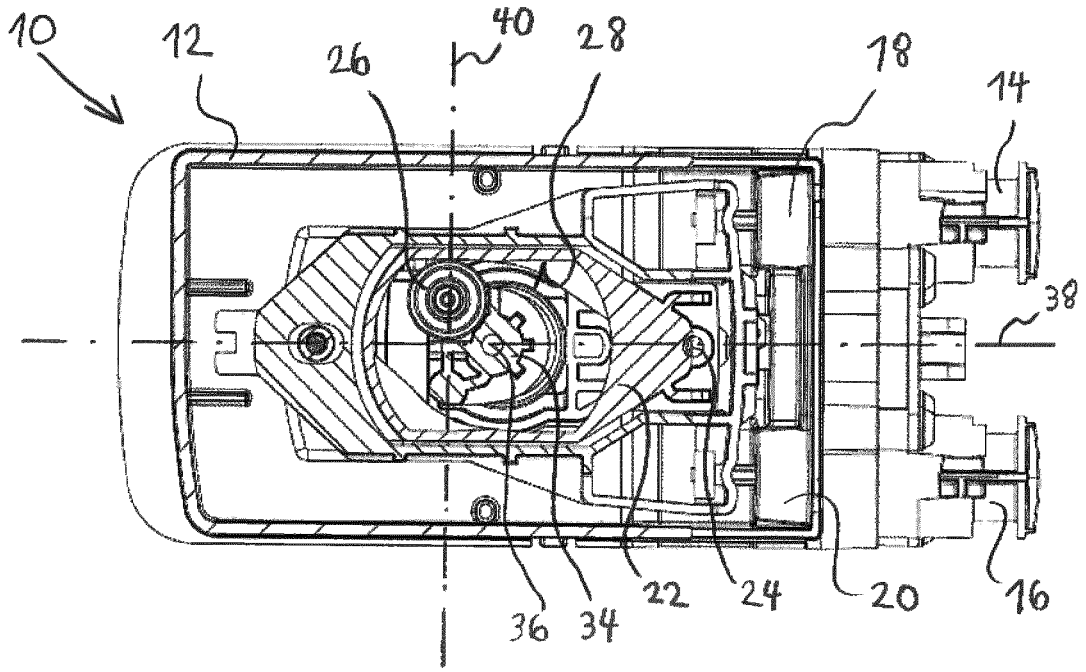
FIG. 3: is schematic sectional top view of the dosage pump of FIG. 2 along a deeper sectional plane.

When the disc 34 is rotated in its 0°-position as illustrated in FIG. 2 and FIG. 3, the rotation axis of the first cam 26 and the second cam 30 are arranged on a cam line 40 which is arranged far away from the tilting axis 24 and perpendicular to the middle line 38. The first cam 26 starts to provide the first tilting force onto the first raceway 28 of the tilting lever 22 for tilting the actuation lever 22 in the first circumferential direction.

Figure 4:
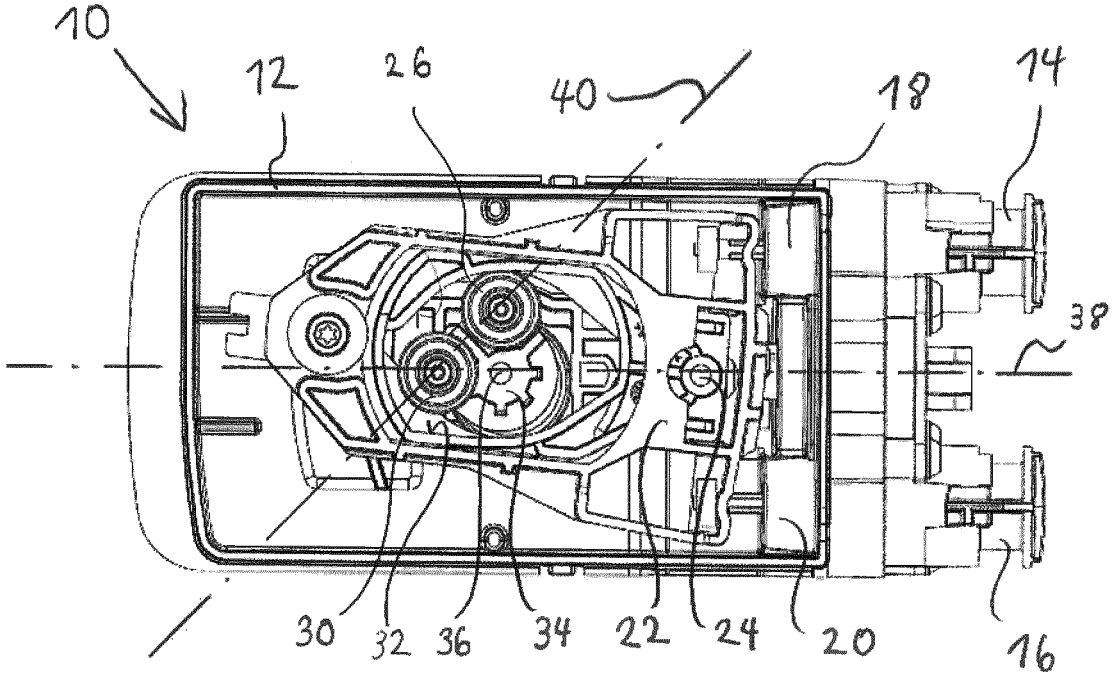
FIG. 4: is a schematic top view of the dosage pump of FIG. 1 after a rotation of a disc by 45° with respect to the dosage pump of FIG. 2, FIG. 5: is a schematic top view of the dosage pump of FIG. 1 after a further rotation of the disc by 45° with respect to the dosage pump of FIG. 4, FIG. 6: is a schematic top view of the dosage pump of FIG. 1 after a further rotation of the disc by 45° with respect to the dosage pump of FIG. 5, FIG. 7: is schematic sectional top view of the dosage pump of FIG. 6 along a deeper sectional plane.

When the disc 34 is rotated in its 45°-position as illustrated in FIG. 4, the second cam 30 is positioned significantly spaced to its second raceway 32 of the actuation lever 22. The whole torque introduced by the disc 34 can be used for providing the first tilting force.

Figure 5:
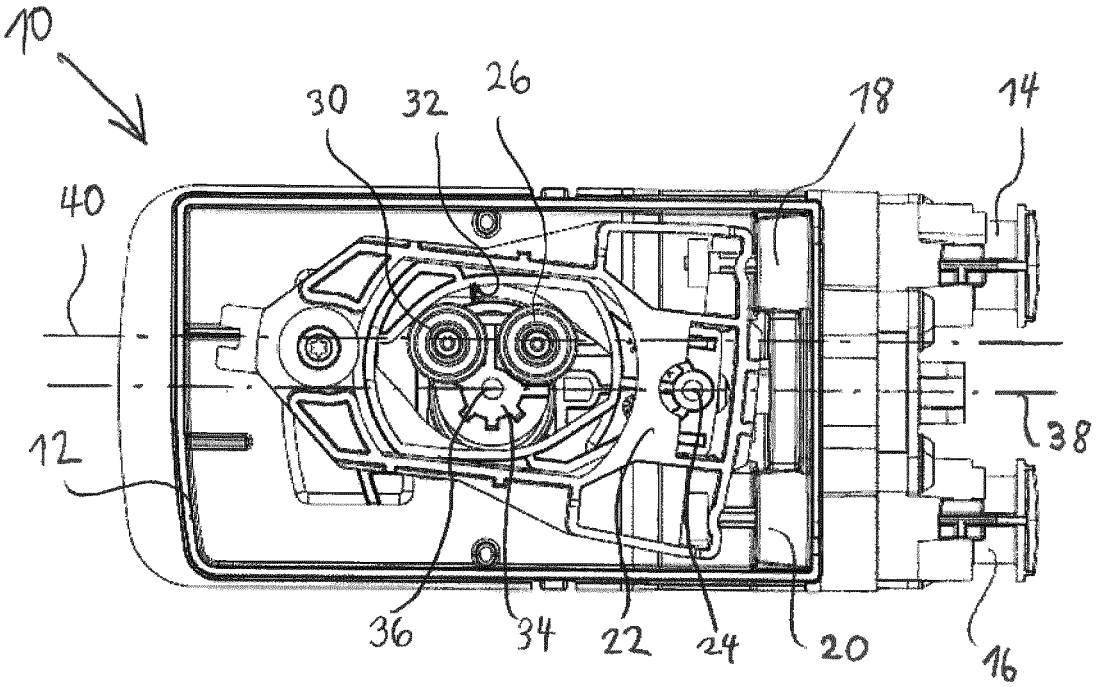

When the disc 34 is rotated in its 90°-position as illustrated in FIG. 5, the cam line 40 is arranged in parallel to the middle line 38. The lever arm of the first cam 26 of a first contact point between the first cam 26 and the first raceway 28 to the tilting axis 24 is quite short and could not be sufficient for providing an actuation force at the second valve 20 for overcoming its reset force and opening the second valve 20. In this situation, the second cam 30 comes into contact with its second raceway 2 of the actuation lever 22. Since the lever arm of a second contact point between the second cam 30 and the second raceway 32 to the tilting axis 24 is larger than provided by the first cam 26 the second tilting force provided by the second cam 30 leads to a higher actuation force at the second valve 20.

Figure 6:
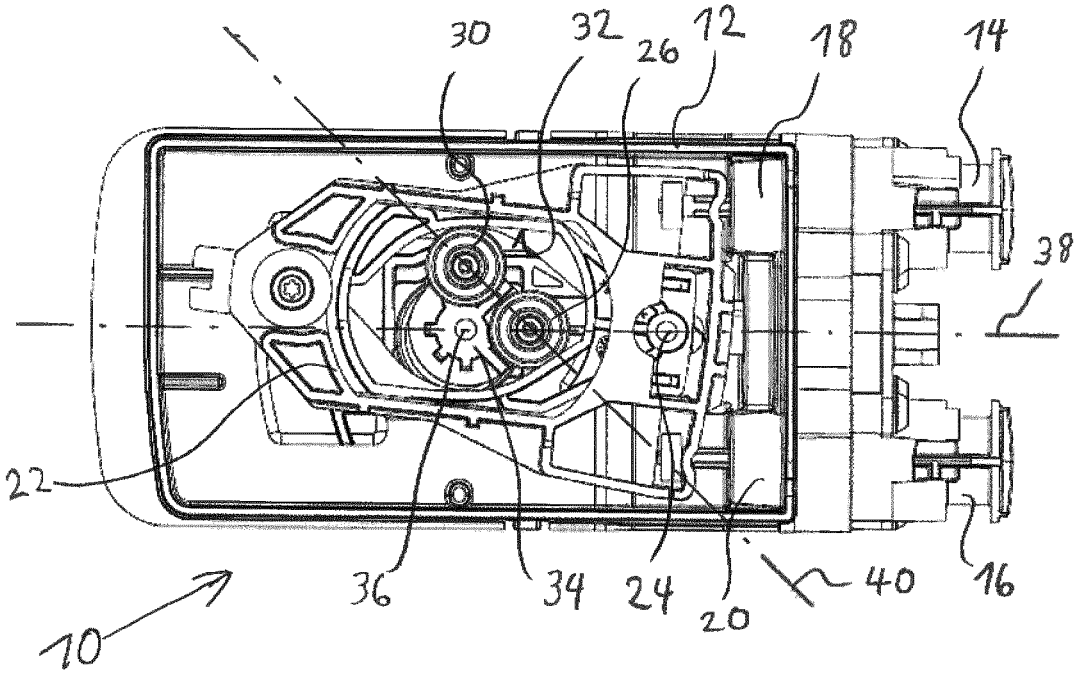
Figure 7:
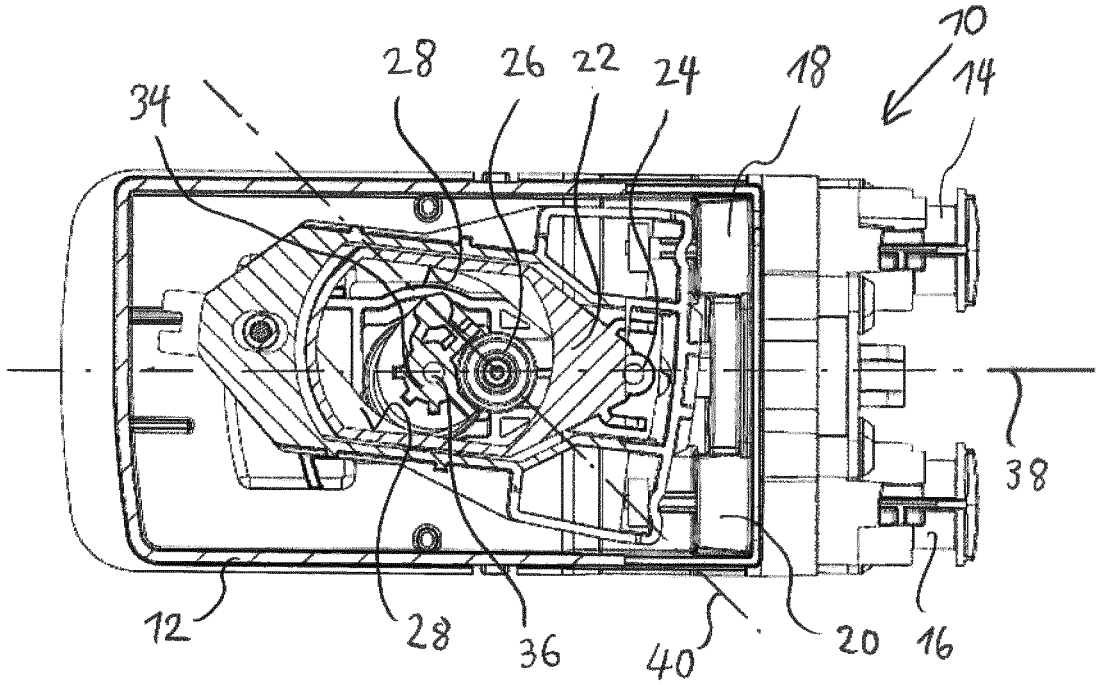

When the disc 34 is rotated in its 135°-position as illustrated in FIG. 6 and FIG. 7, the first cam 26 is lifted from its first raceway 28 of the actuation lever 22.

Figure 8:
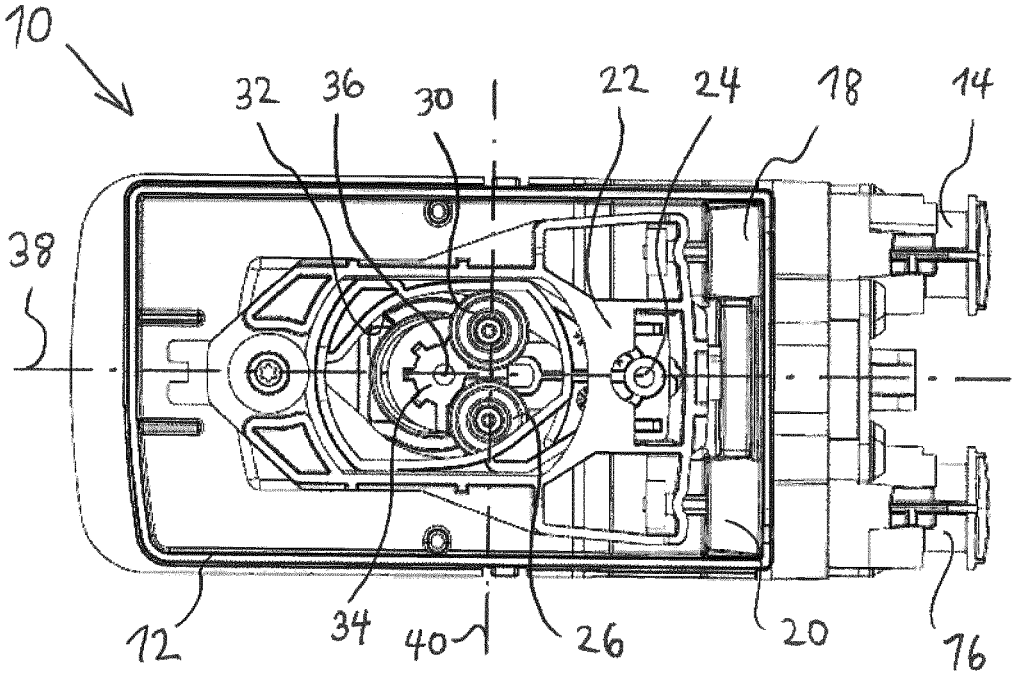
FIG. 8: is a schematic top view of the dosage pump of FIG. 1 after a further rotation of the disc by 45° with respect to the dosage pump of FIG. 6, FIG. 9: is a schematic top view of the dosage pump of FIG. 1 after a further rotation of the disc by 45° with respect to the dosage pump of FIG. 8, FIG. 10: is a schematic top view of the dosage pump of FIG. 1 after a further rotation of the disc by 45° with respect to the dosage pump of FIG. 9, FIG. 11: is a schematic top view of the dosage pump of FIG. 1 after a further rotation of the disc by 45° with respect to the dosage pump of FIG. 10 and FIG. 12: is schematic sectional top view of the dosage pump of FIG. 11 along a deeper sectional plane.

When the disc 34 is rotated in its 180°-position as illustrated in FIG. 8, both the lever arm provided by the first cam 26 and the lever arm provided by the second cam 30 are short. Since the actuation lever 22 shall be tilted in the second circumferential direction and the second valve 20 shall be closed, an actuation force high enough for opening the second valve 20 is not necessary anymore. In fact, a low actuation force provided by the cams 26, 30 enables a tilting of the actuation lever 22 into the second circumferential direction around the tilting axis 24 by means of the reset force of the reset spring inside the second valve 20.

Figure 9:
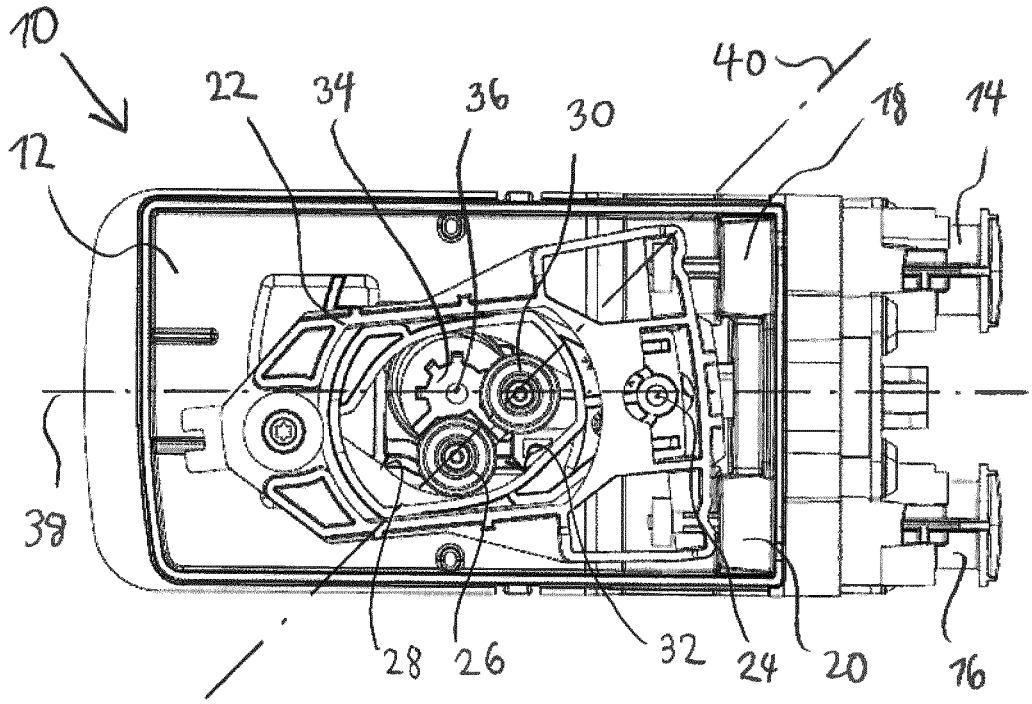

When the disc 34 is rotated in its 225°-position as illustrated in FIG. 9, the reset force of the second valve 20 may not be sufficient anymore for tilting the actuation lever 22 in the second circumferential direction for actuating the first valve 18 so that the first cam 26 take over the function of providing the tilting force onto the actuation lever 22. In this situation, the lever arm provided by the first cam 26 is large enough again for tilting the actuation lever 22 against the reset force of the first valve 18 into the second circumferential direction.

Figure 10:
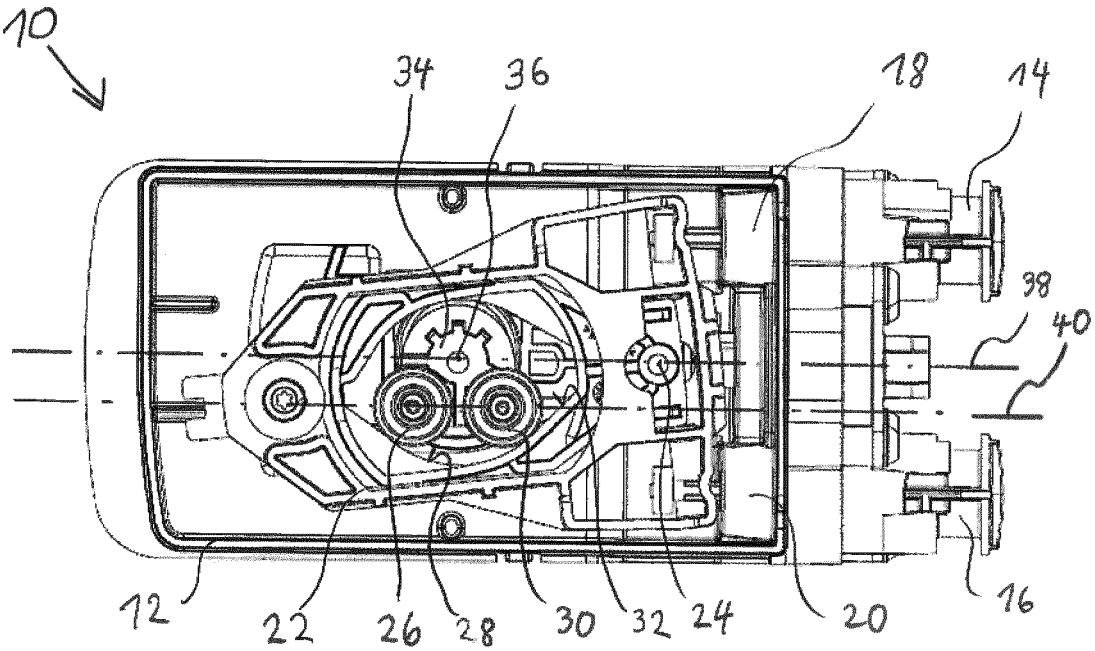

When the disc 34 is rotated in its 270°-position as illustrated in FIG. 10, the second cam 30 may be lifted from its second raceway 32 of the actuation lever 22.

Figure 11:
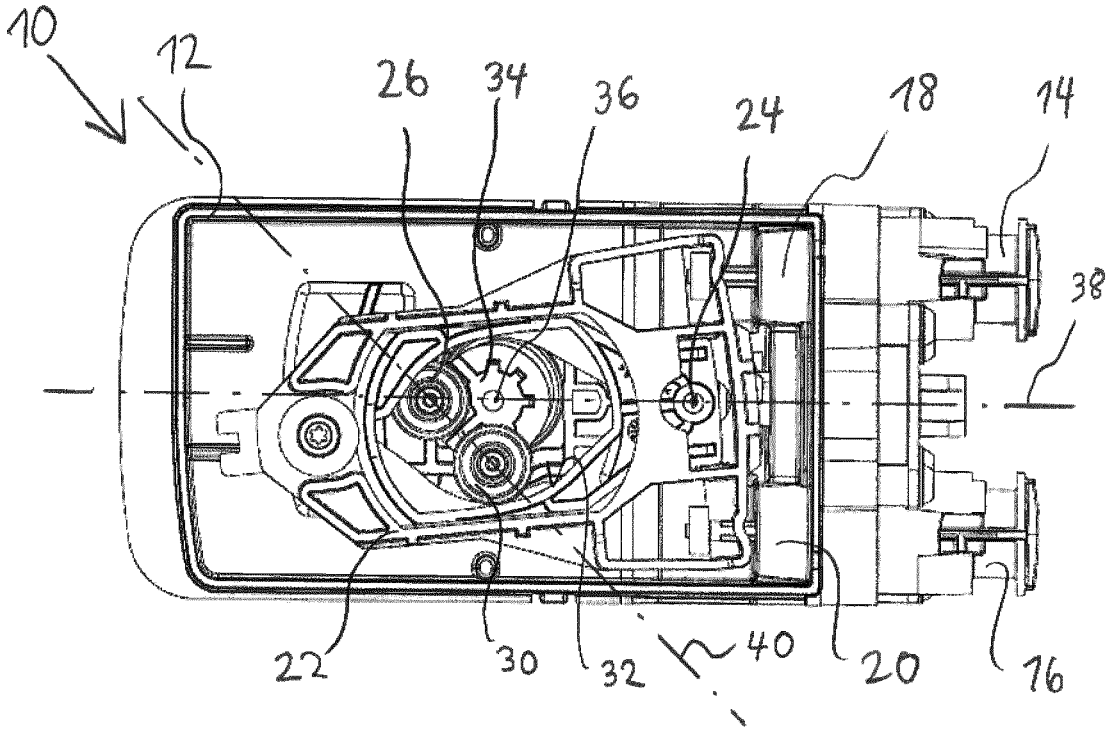
Figure 12:
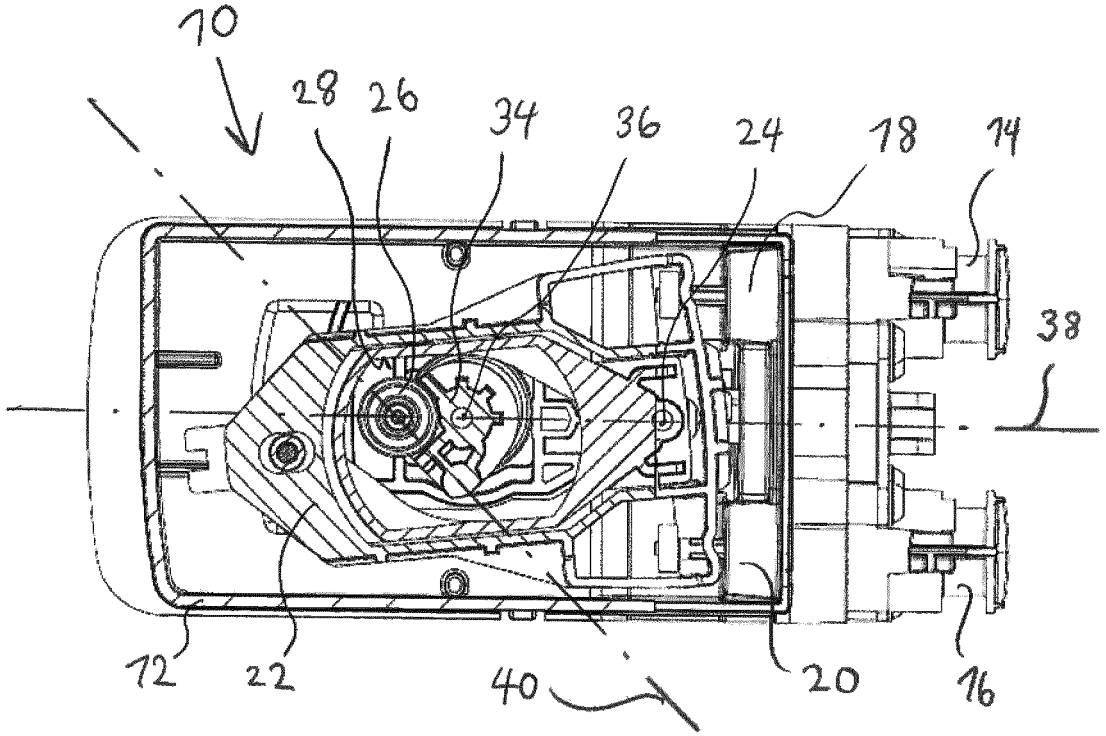

When the disc 34 is rotated in its 315°-position as illustrated in FIG. 11 and FIG. 12, the first valve 18 shall by closed and the actuation lever 22 tilted back into the first circumferential direction, wherein the first valve 18 can be kept open until the disc 34 is rotated in its 360°-position, when the pumping cycle starts again. In this situation, the reset force of the first valve 18 may press the actuation lever 22 against the second cam 30, while the first cam 26 may be lifted from the first raceway 20 of the actuation lever 22.

The invention claimed is:

1. A dosage pump, comprising a pump housing, a first valve for discharging a fluid, a second valve for feeding the fluid, an actuation lever for actuating the first valve as well as the second valve,, wherein the actuating lever is adapted to be tilted around a tilting axis with respect to the pump housing, a rotatable disc for providing a torque generated in a motor connectable to the disc, wherein the disc is adapted to rotate around an input axis of rotation, a first cam connected to the disc and a second cam connected to the disc, wherein the actuating lever comprises a first raceway for bearing a first tilting force for tilting the actuation lever provided by the first cam at a first contact point and a second raceway for bearing a second tilting force for tilting the actuation lever provided by the second cam at a second contact point, wherein the first raceway and the second raceway are formed such that at least partially during an angle of rotation of the disc, where the actuation lever has to apply an actuation force for opening and/or closing the first valve and/or the second valve, the first cam or the second cam, whose contact point to its corresponding raceway is farther away from the tilting axis of the actuation lever and/or adjusted to a lower torque at the actual angle of rotation of the disc, provides the tilting force onto the actuation lever.

2. The dosage pump of claim 1 wherein the first raceway and the second raceway are formed such that at least partially during the angle of rotation of the disc, where the actuation lever has to apply no actuation force, the first cam and the second cam are positioned in an area between the input axis and the tilting axis or the second cam is positioned outside the area between the input axis and the tilting axis.

3. The dosage pump of claim 1 wherein the first raceway and the second raceway are formed such that either the first cam or the second cam only provides the first tilting force or the second tilting force respectively at the actuation lever.

4. The dosage pump of claim 1 wherein the first cam is rotatably connected to the disc and adapted to rotate around a first axis of rotation, wherein the first axis of rotation is aligned mainly in parallel and offset to the input axis of rotation, wherein the second cam is rotatably connected to the disc and adapted to rotate around a second axis of rotation, wherein the second axis of rotation is aligned mainly in parallel and offset to the input axis of rotation.

5. The dosage pump of claim 4 wherein the first cam and/or the second cam is designed as a rotatable roller adapted to roll along the respective first raceway or second raceway.

6. The dosage pump of claim 4 wherein the input axis of the disc and the tilting axis of the actuation lever are arranged on a middle line, wherein the first axis of rotation of the first cam and the second axis of rotation of the second cam are arranged on a cam line, wherein the first raceway and the second raceway are formed such that the presence of the first tilting force provided by the first cam at the first raceway and the second tilting force provided by the second cam at the second raceway changes when the cam line (40) is aligned mainly in parallel to the middle line during the rotation of the disc or inclined to a parallel alignment to the middle line by an angle of maximum 60°.

7. The dosage pump of claim 4 wherein the first axis of rotation of the first cam (26) and the second axis of rotation of the second cam are spaced in circumferential direction with respect to each other by mainly 90°±30°.

8. The dosage pump of claim 4 wherein the first axis of rotation of the first cam and the second axis of rotation of the second cam are positioned at mainly the same radial distance to the input axis of the disc.

9. The dosage pump of claim 1 wherein the first raceway and the second raceway are positioned at different heights with respect to an axial direction of the input axis.

10. The dosage pump of claim 1 wherein the first cam and the second cam are positioned at different heights with respect to an axial direction of the input axis, wherein the first cam overlaps the second raceway at a part of the angle of rotation of the disc and/or the second cam overlaps the first raceway at another part of the angle of rotation of the disc when viewed in an axial direction of the disc.

11. The dosage pump of claim 1 wherein the actuation lever comprises a hollow frame, wherein the first raceway and the second raceway are formed at an inside of the frame.

12. The dosage pump of claim 1 wherein the input axis of the disc and the tilting axis of the actuation lever are arranged on a middle line, wherein the first valve and the second valve are positioned on different sides with respect to the middle line.

13. The dosage pump of claim 1 wherein the first valve and/or the second valve is configured to provide a reset force, wherein the reset force counteracts the actuation force of the actuating lever.

14. The dosage pump of claim 1 wherein the disc is connected to a slidable pusher, wherein the pusher is configured to move back and forth in dependence of the angle of rotation of the disc, wherein the pusher is configured to move a reciprocating diaphragm bordering a fluid chamber for pumping the fluid, wherein the pusher is positioned offset in an axial direction of the input axis with respect to the first cam and the second cam.

15. The dosage pump of claim 1 wherein the disc is connected to a motor, wherein a maximum torque $M_{max}$ provided by the motor is set with respect to a maximum torque $M(\varphi_{max})$ for tilting the actuation lever at a specific angle of rotation $\varphi_{max}$ of the disc such that $75\% \leq M(\varphi_{max})/M_{max} \leq 100\%$.

* * * * *